US008579583B2

(12) United States Patent
Böck

(10) Patent No.: US 8,579,583 B2
(45) Date of Patent: Nov. 12, 2013

(54) STRUT FOR AN INTERMEDIATE TURBINE HOUSING, INTERMEDIATE TURBINE HOUSING, AND METHOD FOR PRODUCING AN INTERMEDIATE TURBINE HOUSING

(75) Inventor: Alexander Böck, Kottgeisering (DE)

(73) Assignee: MTU Aero Engines AG, Munich (DE)

( * ) Notice: Subject to any disclaimer, the term of this patent is extended or adjusted under 35 U.S.C. 154(b) by 492 days.

(21) Appl. No.: 12/937,988

(22) PCT Filed: Apr. 17, 2009

(86) PCT No.: PCT/DE2009/000527

§ 371 (c)(1),
(2), (4) Date: Oct. 14, 2010

(87) PCT Pub. No.: WO2009/127203

PCT Pub. Date: Oct. 22, 2009

(65) Prior Publication Data

US 2011/0033290 A1 Feb. 10, 2011

(30) Foreign Application Priority Data

Apr. 17, 2008 (DE) ..... 10 2008 019 156

(51) Int. Cl.
*F01D 25/28* (2006.01)

(52) U.S. Cl.
USPC ..... 415/182.1; 415/209.4; 415/210.1

(58) Field of Classification Search
USPC ..... 415/142, 182.1, 208.1, 208.2, 209.3, 415/209.4, 210.1
See application file for complete search history.

(56) References Cited

U.S. PATENT DOCUMENTS 4,987,736 A * 1/1991 Ciokajlo et al. ..... 60/797
5,292,227 A 3/1994 Czachor et al.

(Continued)

FOREIGN PATENT DOCUMENTS

EP 0 550 126 A 7/1993
EP 2058476 A1 5/2009
GB 2 226 086 A 6/1990

OTHER PUBLICATIONS

European Patent Office; Examination Report for (related) Application No. 09 733 089.9-2321; dated Feb. 16, 2012; 4 pages.

(Continued)

*Primary Examiner* — Edward Look
*Assistant Examiner* — Christopher R Legendre
(74) *Attorney, Agent, or Firm* — Howison & Arnott, L.L.P.

(57) ABSTRACT

The present invention relates to a strut for a turbine center frame of a jet engine, in particular a gas turbine, with a first end for disposition on an internal structure of the turbine center frame and a second end opposite the first end for attaching the strut on a housing or an internal boundary wall of the turbine center frame, and on the second end at least one flange-like element with at least one first aperture is removably arranged with at least one first aperture for accommodating or passing through an attachment means. The invention further relates to a turbine center frame for a jet engine, in particular a gas turbine as well as a method for producing a turbine center frame of a jet engine, in particular a gas turbine.

15 Claims, 2 Drawing Sheets

(56) References Cited

U.S. PATENT DOCUMENTS

| | | | | |
|---|---|---|---|---|
| 5,438,756 | A * | 8/1995 | Halchak et al. | 29/889.2 |
| 5,483,792 | A * | 1/1996 | Czachor et al. | 60/796 |
| 6,358,001 | B1 * | 3/2002 | Bosel et al. | 415/142 |
| 6,860,716 | B2 * | 3/2005 | Czachor et al. | 415/142 |
| 8,303,246 | B2 * | 11/2012 | Drelon et al. | 415/142 |
| 2011/0033290 | A1 * | 2/2011 | Bock | 415/209.3 |
| 2011/0038667 | A1 | 2/2011 | Drelon et al. | |

OTHER PUBLICATIONS

Patent Cooperation Treaty; Written Opinion of PCT/DE09/000527; 7 pages.

Patent Cooperation Treaty; Written Opinion of PCT/DE09/000527; 14 pages.

Patent Cooperation Treaty; International Search Report of PCT/DE09/000527; 3 pages.

Patent Cooperation Treaty; International Search Report of PCT/DE09/000527; 4 pages.

* cited by examiner

STRUT FOR AN INTERMEDIATE TURBINE HOUSING, INTERMEDIATE TURBINE HOUSING, AND METHOD FOR PRODUCING AN INTERMEDIATE TURBINE HOUSING

CROSS-REFERENCE TO RELATED APPLICATIONS

The present application is a U.S. National Phase application submitted under 35 U.S.C. §371 of Patent Cooperation Treaty Application Serial No. PCT/DE2009/000527, filed Apr. 17, 2009, entitled STREBE FÜR EIN TURBINENZWISCHENGEHÄUSE, TURBINENZWISCHENGEHÄUSE UND VERFAHREN ZUR HERSTELLUNG EINES TURBINENZWISCHENGEHÄUSES, which application claims priority to German Application Serial No. 10 2008 019 156.6, filed Apr. 17, 2008, entitled STREBE FÜR EIN TURBINENZWISCHENGEHÄUSE, TURBINENZWISCHENGEHÄUSE UND VERFAHREN ZUR HERSTELLUNG EINES TURBINENZWISCHENGEHÄUSES, the specifications of which are incorporated herein by reference in their entireties.

TECHNICAL FIELD

The present invention relates to a strut for a turbine center frame of a jet engine, in particular of a gas turbine, with a first end for disposition on an internal structure of the turbine center frame and a second end that is opposite the first end for the attachment of the strut onto a housing or an internal boundary wall of the turbine center frame. The invention further relates to a turbine center frame for a jet engine, in particular a gas turbine, and a method for producing a turbine center frame of a jet engine, in particular a gas turbine.

BACKGROUND

Turbine center frames in jet engines, in particular with a gas turbine of an aircraft engine, are arranged between the high-pressure turbine and the low-pressure turbine. The turbine center frame (TCF) is a structural component and has the function to form a flow path between the high-pressure turbine and the low-pressure turbine and to structurally connect the bearing chamber of at least the high-pressure rotor with the housing. In addition, the turbine center frame serves for the distribution of cooling air flow for the low-pressure turbine. In this context, profiled struts which hold a bearing chamber for the turbine rotor, cross the gas duct. For this reason, the struts are encased with components that are similar to guide vanes. In this context it was found to be economical, if the struts are cast together with the bearing chamber and/or the internal structure of the turbine center frame. In this case, however, the strut casing must be able to be mounted radially across the struts from the outside. But since the free ends of the struts are mounted on a housing or on an inner boundary wall of the turbine center frame, they normally have a thick spot in this area or a flange, which defines the width of the strut casing with this type of assembly. For this reason, with these types of struts, only strut casings can be used that are correspondingly wide and are not flow optimized, which is a disadvantage. This however reduces the efficiency of the gas turbine, since relatively high flow losses occur. To prevent this, in the case of other known turbine center frames, a single-piece design of the struts with the internal structure, i.e. as an integrally cast bearing support, for example, is dispensed with. This on the other hand will increase the production costs of the turbine center frame, however.

SUMMARY AND DESCRIPTION

The object of the present disclosure is therefore to provide a generic strut for a turbine center frame which facilitates a simple casing with a flow-optimized and slender design.

Furthermore, the object of the present disclosure is to provide a generic turbine center frame that has a higher efficiency compared to known turbine center frames.

The object of the present disclosure is furthermore to provide a generic method for producing a turbine center frame, which ensures the rapid production of the turbine center frame overall and simple and fast encasing of struts of the turbine center frame with a flow-optimized and slender strut casing design.

These problems are addressed by a strut, a turbine center frame and a method for producing a turbine center frame according to the features disclosed herein.

Advantageous embodiments of the invention can be found in the respective claims and sub-claims.

A strut for a turbine center frame of a jet engine as taught by one embodiment, in particular for a gas turbine, comprises a first end for disposition on an internal structure of the turbine center frame and a second end opposite the first end for attaching the strut on a housing or an internal boundary wall of the turbine center frame, and on the second end at least one flange-like element is removably arranged with at least one first aperture for accommodating or passing through an attachment means. Because of the removable arrangement of the flange-like element, it is possible to initially slide a flow-optimized strut casing over the strut radially from the outside and then only subsequently arrange the flange-like element on the second end and to attach the strut by means of the flange-like element on the housing or the inner boundary wall of the turbine center frame. The ability of fitting more slender, flow-optimized strut casings significantly reduces the flow losses within the turbine center frame, which in turn results in a higher efficiency of the jet engine. An additional advantage is that it is possible that the strut as taught by the invention is used as part of an integrally cast bearing support, which can be produced economically.

In a preferred embodiment of the strut, said strut comprises at least one groove or recess into which a corresponding projection of the flange-like element can engage. This facilitates an easy assembly of the flange-like element on the strut in the area of the second end of the strut.

In a further preferred embodiment of the strut, it comprises at least one additional peripheral or non-peripheral flange on its second end. Through the flange, it increases the contact surface between the strut and/or the second end of the strut and the housing to be connected therewith or the internal boundary wall of the turbine center frame to be connected therewith. In this embodiment, the flange-like element attaches on the flange of the strut. In this context, the flange can develop at least one support surface to support one shoulder of the flange-like element.

In a further preferred embodiment of the strut, the flange-like element comprises at least one support surface for support on the housing or of the internal boundary wall of the turbine center frame. By developing an additional supporting surface, this results in uniform pressure distribution between the strut and the housing and/or the internal boundary wall of the turbine center frame.

In a further preferred embodiment, the strut comprises at least one second aperture on the second end for accommodating or passing through of an attachment means. In this context, the second aperture can be developed in the flange or also in a second flange-like element. Through the development of a second aperture, a fixed and close connection between these elements results after the attachment of the strut on the housing or the internal boundary wall of the turbine center frame. It is also conceivable that this connection not only occurs with two attachment means, but also with a plurality of attachment means.

The attachment means is usually a bolt.

In a further preferred embodiment, on the second end of the strut and on the flange-like element, corresponding apertures are developed in the flange for accommodating a dowel pin. For this purpose, the dowel pin preferably serves for holding the flange-like element on the strut during the attachment, in particular for bolting onto the housing or the internal boundary wall of the turbine center frame.

In a further preferred embodiment, the strut with the internal structure of the turbine center frame is designed as a single piece. In addition, the strut is surrounded at least partially by a strut casing, and the strut casing design is flow-optimized. The strut casing can moreover consist of a heat resistant material.

A turbine center frame as taught by another embodiment for a jet engine, in particular a gas turbine, comprises several struts that are arranged radially on an internal structure for connection with a housing or an internal boundary wall of the turbine center frame, where the struts are designed as described in the foregoing. In this context, the jet engine can be a gas turbine of an aircraft engine. The turbine center frame of this embodiment has a higher efficiency when compared with known turbine center frames, because the struts used are provided with flow-optimized strut casings. Because of the slender and flow-optimized strut casings, flow losses are reduced and thus a higher efficiency of the gas turbine, in particular of the aircraft engine, is possible.

A method as taught by yet another embodiment for producing a turbine center frame of a jet engine, in particular of a gas turbine, comprises the following steps:

a) Provision of an internal structure of the turbine center frame with several struts that are radially arranged, and where the struts are designed in each case as described in the foregoing; b) assembly of at least one strut casing on the individual struts, and the strut casing surrounds the struts either completely or partially in each case, and the assembly is performed radially from the outside; c) connecting the second ends of the struts in each case with at least one flange-like element; and d) connecting the flange-like elements or the flange-like elements and the respective flange of the struts with a housing or an internal boundary wall of the turbine housing. The method facilitates the rapid production of the turbine center frame overall and a simple and fast encasing of the struts of the turbine center frame with a flow-optimized and slender strut casing design. The thick spots that are normally formed on the free strut ends of the state-of-the-art struts do no longer determine the width of the strut casing. The more slender and flow-optimized strut casings that can be used reduce the flow losses within the turbine center frame and thus facilitate a higher efficiency of the jet engine.

In a preferred embodiment of the method, the connection according to process step d) is done by means of screwing. The connection according to process step c) can be done by means of a dowel pin which is mounted in the flange of the second end of the strut and the flange-like element in corresponding apertures. This will ensure a quick and secure fixation of the flange-like element on the strut.

BRIEF DESCRIPTION OF THE DRAWINGS

Further advantages, features, and particulars of the invention result from the following description of the two embodiments represented in the drawings, as follows.

DETAILED DESCRIPTION

Figure 1:
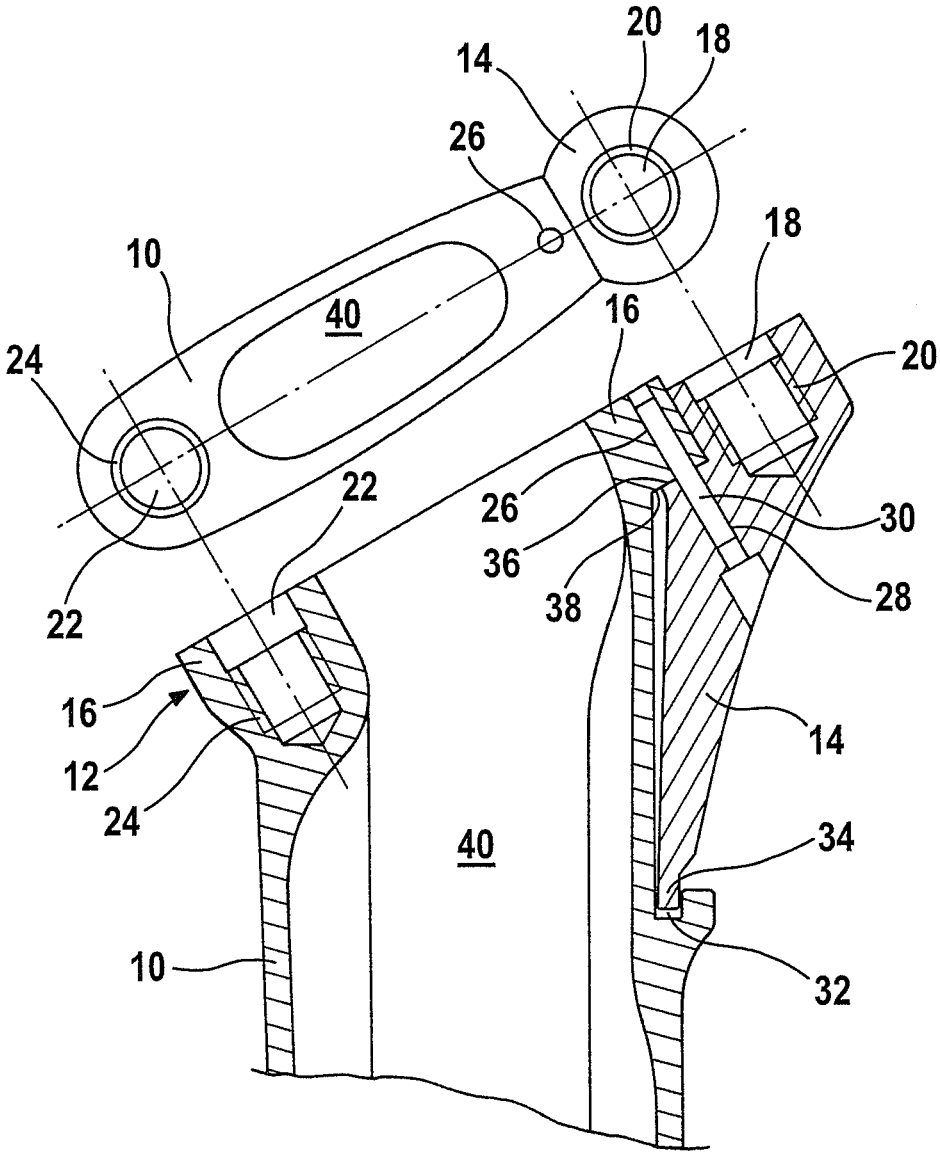
FIG. 1 is a schematic representation of a strut as taught by the invention for a turbine center frame according to a first embodiment.

FIG. 1 illustrates a schematic representation of a strut 10 for a turbine center frame of a jet engine, in particular a gas turbine for an aircraft engine. In this case, the strut 10 is designed as a single piece with an internal structure of the turbine center frame (not shown). In particular, several struts 10 together with the internal structure are forming a so-called integrally cast bearing support. For this purpose, the bearing support serves to support shafts and/or rotors of a gas turbine. In the upper area of FIG. 1, the strut 10 is shown as a horizontal projection and in the lower area a corresponding sectional view is shown. This clearly shows that strut 10 has a profiled design. Furthermore, it can be seen that strut 10 has a first end for disposition on the internal structure of the turbine center frame (not shown) and a second end 12 positioned opposite the first end for attaching the strut 10 on a housing 42 (see FIG. 2) or on an internal boundary wall of the turbine center frame. For this purpose, a flange-like element 14 with a first aperture 18 for accommodating an attachment means, in particular a bolt (not shown), is removably arranged on the second end 12.

In the illustrated embodiment, the flange-like element 14 has an elongated shape, and the maximum of the longitudinal extension runs along the longitudinal axis of the strut 10. In this case, the flange-like element 14 has a projection 34, which engages into a groove 32 that is developed in strut 10. The flange-like element 14 also has a shoulder 36 at the end that is opposite the projection 34, which is supported on a support surface 38 of a flange 16 of the strut 10. In the illustrated embodiment, the flange 16 has a partially peripheral shape on the second end 12 of the strut 10.

Furthermore it can be seen that a second aperture 22 for accommodating a second attachment means is developed in the end of the strut 10 that is opposite the flange-like element 14 and/or the first aperture 18. In this context, both the first aperture 18 as well as the second aperture 22 each have an internal thread 20, 24 for insertion and attachment of a bolt with a corresponding external thread. In this instance, the second aperture 22 is developed in flange 16.

Furthermore, corresponding apertures 26, 28 for accommodating a dowel pin 30 are developed in flange 16 and in the flange-like element 14. This facilitates a simple and secure attachment of the flange-like element 14 on the strut 10 in the area of the second end 12. Prior to attaching the flange-like element 14 on the strut 10, a flow-optimized, slender strut casing is pushed over the strut 10 from the outside. Subsequently, the flange-like element 14 is attached on the strut 10 with the help of the dowel pin 30, so that the second end 12 of the strut 10 and the housing 42 can be screwed together in a further step.

Furthermore it can be seen that the strut 10 has a hollow design and comprises a gas duct 40.

Figure 2:
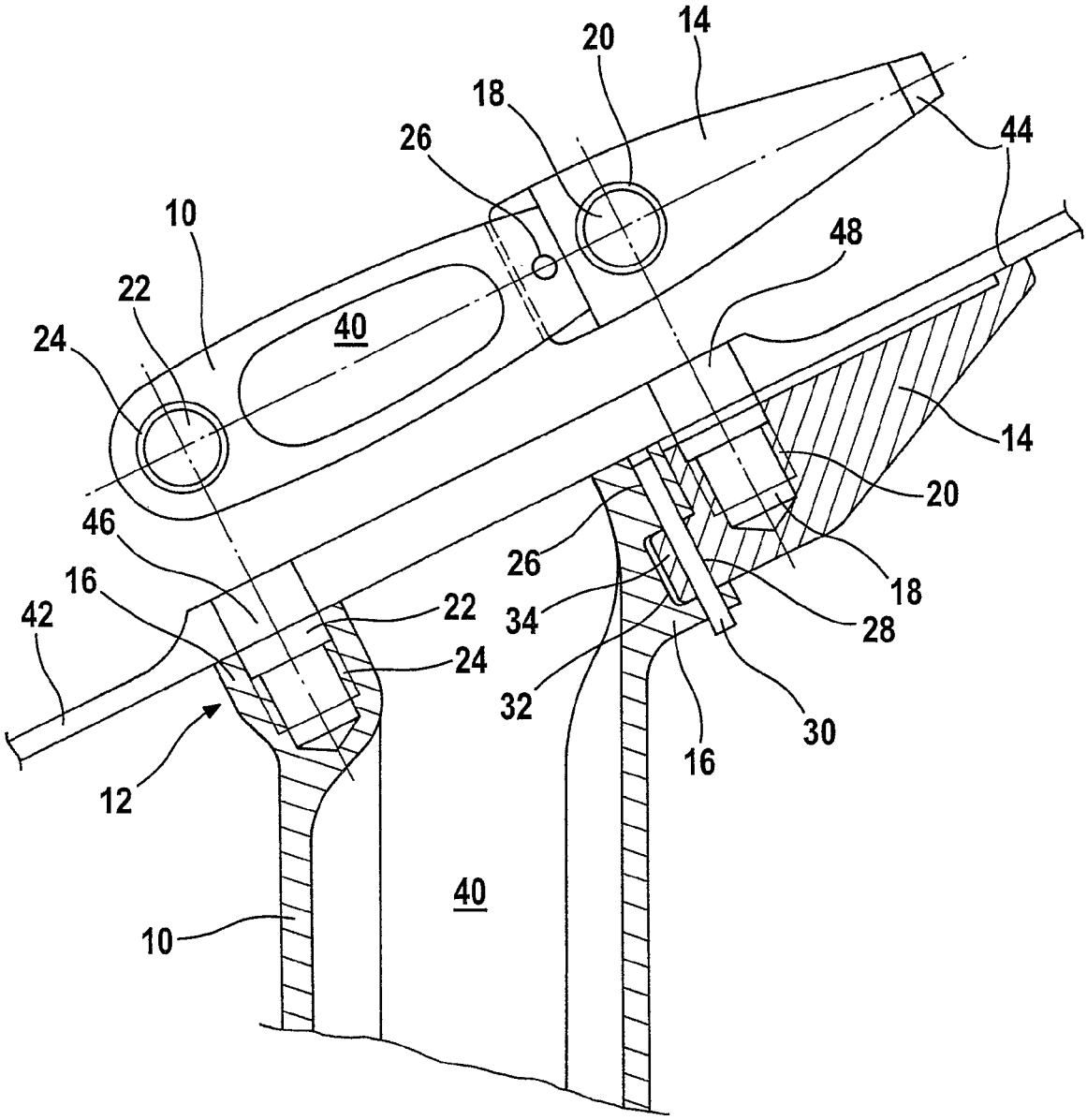
FIG. 2 is a schematic representation of a strut as taught by the invention for a turbine center frame according to a second embodiment.

FIG. 2 illustrates a schematic representation of a strut 10 according to a second embodiment. FIG. 2 also has a horizontal projection of the strut 10 in the upper area and the corresponding sectional view of the strut 10 in a lower area. The strut 10 according to the second embodiment basically has a comparable structure as that of strut 10 of the first embodiment described in FIG. 1. The same reference numbers in the FIGS. 1 and 2 therefore denote the same elements of struts 10 in each case. In contrast to the embodiments illustrated in FIG. 1, however, here the flange-like element 14 is not arranged in its longitudinal direction approximately parallel to the longitudinal axis of the strut 10. Rather, the longitudinal axis of the likewise longitudinally developed flange-like elements 14 runs approximately perpendicular in relation to the longitudinal axis of the strut 10. It can be seen, that on the end of the flange-like element 14 facing away from the strut 10, a support surface 44 for supporting the housing 42 is developed. On the end opposite of the support surface 44, the flange-like element 14 again has a protrusion 34, which engages in the corresponding groove and/or recess 32 in the area of the second end 12 of the strut 10. For this purpose, the recess 32 and the projection 34 are designed such that parallel surfaces are developed, which prevent twisting of the flange-like element 14 relative to strut 10 during the assembly.

The flange-like element 14 is held in turn on the strut 10 by means of a dowel pin 30. To accommodate and support the dowel pin 30, the flange 16 of the second end 12 of the strut 10, in turn has an aperture 26 that corresponds with an aperture 28 in the flange-like element 14. The aperture 28 is here developed in the protrusion 34 in the illustrated embodiment. The aperture 26 extends on both sides of the walls of the flange 16 surrounding the recess 32.

For the attachment of the housing 42 on the strut 10, the housing 42 also comprises two apertures 46, 48, which correspond with the first aperture 20 and the second aperture 22 of the flange-like element 14 and/or the flange 16. The connection of the housing 42 with the strut 10 is done by means of a screw joint in this case. Before this connection, the strut 10 is again provided with an appropriate strut casing that is developed flow-optimized, as it was already described in the embodiment presented in FIG. 1. Also the strut 10 represented in FIG. 2 is developed as a single piece with an internal structure of the turbine center frame (not shown).

The invention claimed is:

1. A strut for a turbine center frame of a jet engine having a turbine center frame, a housing and a strut casing, the strut comprising:

a first end for connection to an internal structure of the turbine center frame;

a second end, disposed opposite the first end, for connection to the housing;

wherein the second end includes a flange-like element having at least one first aperture for accommodating a first attachment element for connecting the flange-like element to the housing;

a flange having at least one second aperture for accommodating a second attachment element for connecting the flange to the housing; and wherein the flange-like element is removably connectable to the flange such that, when the flange-like element is connected to the flange, a strut casing may not pass over the flange toward the first end of the strut, but when the flange-like element is not connected to the flange, the strut casing may pass over the flange toward the first end of the strut.

2. A strut in accordance with claim 1, wherein the strut has one of a groove and a recess disposed proximate the second end into which a corresponding protrusion of the flange-like element engages.

3. A strut in accordance with claim 1, wherein the flange forms at least one support surface for supporting a shoulder of the flange-like element.

4. A strut in accordance with claim 1, wherein the flange-like element has at least one support surface for supporting the housing.

5. A strut in accordance with claim 1, wherein the second end further comprises at least one third aperture for accommodating an attachment element for connecting the flange-like element to the flange.

6. A strut in accordance with claim 5, wherein at least one such third aperture is disposed in the flange.

7. A strut in accordance with claim 5, wherein at least one such third aperture is disposed in the flange-like element.

8. A strut in accordance with claim 5, wherein third apertures are disposed in both the flange and the flange-like element for accommodating a dowel pin for connecting the flange to the flange-like element.

9. A strut in accordance with claim 1, wherein the strut is formed as a single piece with the internal structure of the turbine center frame.

10. A strut in accordance with claim 1, wherein the strut is surrounded at least partially by a strut casing.

11. A turbine center frame for a jet engine having a housing and a plurality of strut casings, the center frame comprising:

an internal structure;

a plurality of struts, each strut connected at a first end to the internal structure and having a second end radially disposed therefrom for connection to a housing;

wherein the second end of each strut includes a flange-like element having at least one first aperture for accommodating a first attachment element for connecting the flange-like element to the housing;

a flange having at least one second aperture for accommodating a second attachment element for connecting the flange to the housing; and wherein the flange-like element is removably connectable to the flange such that, when the flange-like element is connected to the flange, a strut casing may not pass over the flange toward the first end of the strut, but when the flange-like element is not connected to the flange, the strut casing may pass over the flange toward the first end of the strut.

12. A turbine center frame in accordance with claim 11, wherein the jet engine is a gas turbine of an aircraft engine.

13. A method for producing a turbine center frame of a jet engine having a housing and a plurality of strut casings, the method comprising the following steps:

a) providing an internal structure of a turbine center frame and a plurality of struts, each strut connected at a first end to the internal structure and having a second end radially disposed therefrom for connection to a housing, wherein the second end of each strut includes a flange-like element having at least one first aperture for accommodating a first attachment element for connecting the flange-like element to the housing and a flange having at least one second aperture for accommodating a second attachment element for connecting the flange to the housing, and wherein the flange-like element is removably connectable to the flange such that, when the flange-like element is connected to the flange, a strut casing may not pass over the flange toward the first end of the strut, but when the flange-like element is not connected to the flange, the strut casing may pass over the flange toward the first end of the strut;

b) assembling at least one strut casing on each individual strut, the assembly being performed radially from outside when the corresponding flange-like elements are not connected to the flanges;

c) connecting the corresponding flange-like elements to the flanges; and d) connecting the second ends of the struts to the housing.

14. A method in accordance with claim 13, wherein step d) is performed by means of screwing.

15. A method in accordance with claim 13, wherein the connection according to step c) is performed by means of a dowel pin.

* * * * *